US005239951A

United States Patent [19]

Rao et al.

[11] Patent Number: 5,239,951

[45] Date of Patent: Aug. 31, 1993

[54] VALVE LIFTER

[75] Inventors: V. Durga N. Rao, Bloomfield Hills; Gregory E. Schafer, Dearborn; Robert J. Natkin, Allen Park, all of Mich.

[73] Assignee: Ford Motor Company, Dearborn, Mich.

[21] Appl. No.: 974,568

[22] Filed: Nov. 12, 1992

[51] Int. Cl.[5] ..... F01L 1/16

[52] U.S. Cl. ..... 123/90.5; 123/90.51; 74/569

[58] Field of Search ..... 123/90.48, 90.5, 90.51, 123/90.33; 74/569

[56] References Cited

U.S. PATENT DOCUMENTS

| | | | |
|---|---|---|---|
| 4,153,017 | 5/1979 | Behnke | 123/90.51 |
| 4,406,257 | 9/1983 | Keske et al. | 123/90.51 |
| 4,594,973 | 6/1986 | Allred et al. | 123/90.4 |
| 4,708,102 | 11/1987 | Schmid | 123/90.5 |
| 4,871,266 | 10/1989 | Oda | 384/42 |
| 4,872,432 | 10/1989 | Rao et al. | 123/193 CP |
| 4,873,150 | 10/1989 | Doi et al. | 123/90.51 |
| 4,909,198 | 3/1990 | Shiraya et al. | 123/90.51 |
| 4,917,953 | 4/1990 | Hioki et al. | 428/408 |
| 4,995,281 | 2/1991 | Allor et al. | 74/559 |
| 5,029,562 | 7/1991 | Kamo | 123/193 P |
| 5,035,959 | 7/1991 | Ito et al. | 123/90.51 |
| 5,052,352 | 10/1991 | Taniguchi et al. | 123/90.51 |
| 5,054,440 | 10/1991 | Kadokawa | 123/90.51 |
| 5,060,607 | 10/1991 | Taniguchi | 123/90.51 |
| 5,063,894 | 11/1991 | Mielke et al. | 123/193 P |
| 5,186,130 | 2/1993 | Melchior | 123/90.5 |

FOREIGN PATENT DOCUMENTS

| | | |
|---|---|---|
| 3239325 | 4/1984 | Fed. Rep. of Germany . |
| 58-214609 | 12/1983 | Japan . |
| 2093554 | 9/1982 | United Kingdom . |

*Primary Examiner*—Willis R. Wolfe
*Assistant Examiner*—Weilun Lo
*Attorney, Agent, or Firm*—Joseph W. Malleck; Roger L. May

[57] ABSTRACT

A valve lifter of the roller type formed of a lightweight metal preferably aluminum or magnesium alloy. A roller formed of a wear resistant ceramic material is rotatably secured to the valve lifter. The wear/bearing surfaces of the valve lifter are impregnated with a solid film lubricant to provide reduced friction during operation.

18 Claims, 1 Drawing Sheet

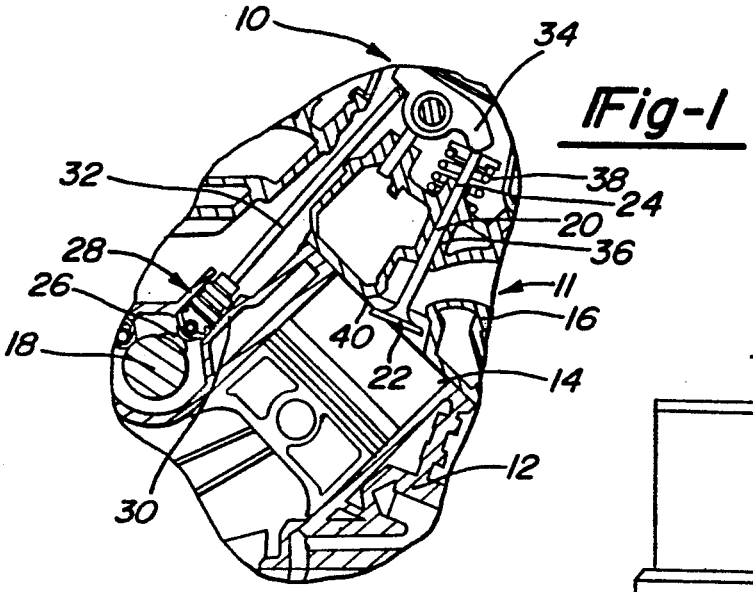
Fig-1
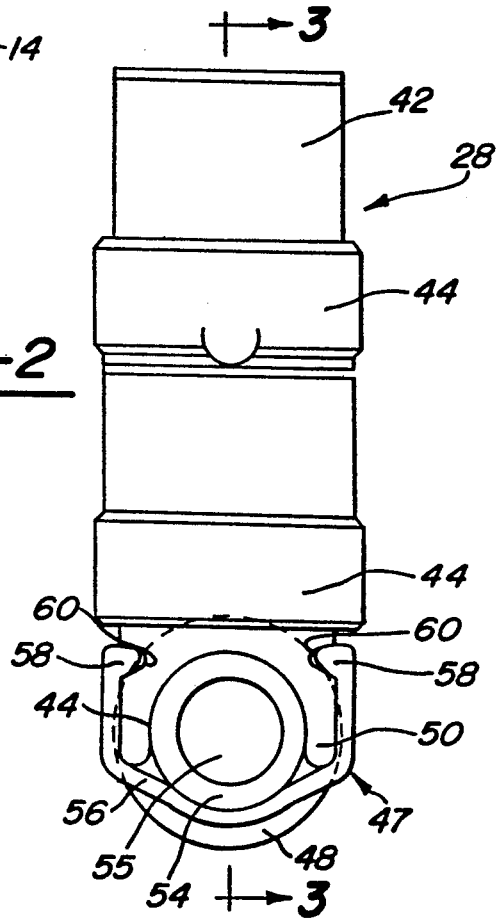
Fig-2
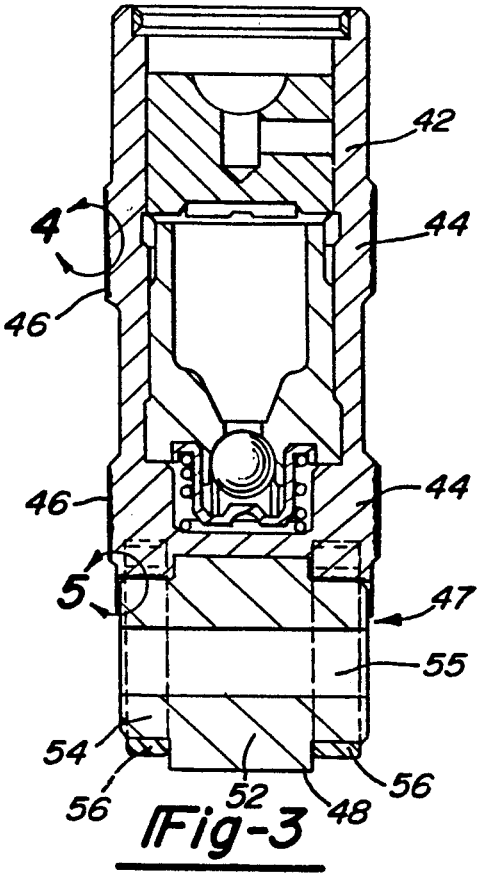
Fig-3
Fig-4
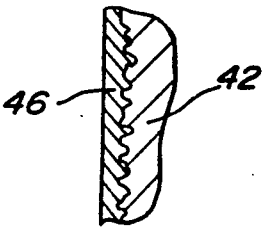
Fig-5
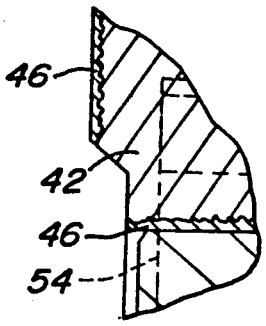

VALVE LIFTER

BACKGROUND OF THE INVENTION

1. Field of the Invention

The present invention relates generally to a valve lifter for use in opening a valve of an engine such as an internal combustion engine 2. Description of the Related Art Typically, internal combustion engines utilize a pair of intake and exhaust valves which are opened and closed synchronously due to the rotation of a cam shaft. It is known to construct valve trains for opening and closing the valves in such engines. Generally, a valve train includes a valve lifter which is placed adjacent a cam lobe on a cam shaft which is used to translate rotational motion of the cam shaft into axial motion of the valve. Typically, this is accomplished through a push rod and rocker arm assembly acting directly upon the valve. The valve is closed by a valve spring which biases the valve in a closed position.

One of the major sources of the frictional forces occurring in a driven valve train is the valve spring force required to counteract the inertia forces generated by the reciprocating mass, i.e., rocker arm, valve lifter, and push rod, and close the valve with adequate sealing. Conventionally, the valve lifter is made of a harden steel material which produces a relatively high reciprocating mass and valve spring force, thus limiting the maximum engine speed. Thus, there is a need in the art to reduce the reciprocating mass and valve spring force, correspondingly reducing the friction and increasing engine speed.

However, lightweight components typically have a low wear coefficient and normally include some sort of hard coating to increase their useful life. In the past, the peripheral surface of valve lifters have been coated with a hard material to prevent wear and increase the useful life of the lifter. While the coatings have increased the useful life of the valve lifter, they do not adequately reduce the coefficient of friction at the valve lifter/-valve lifter guide interface. Thus, there is a need in the art to reduce the friction at the valve lifter and valve guide interface to increase the efficiency of the valve train, resulting in greater fuel economy of the engine.

Additionally, friction between the valve lifter and the cam lobe has been reduced through the use of a roller cam follower as opposed to a slider type follower. Typically, roller cam followers are mounted on needle bearings and in some instances have been journaled on a shaft. However, there is a need in the art to reduce the weight of roller cam followers.

SUMMARY OF THE INVENTION

Accordingly, the present invention is a unique valve lifter for use in a valve train of an engine such as an internal combustion engine. In general, the valve lifter includes a lightweight valve lifter body having a cradle formed on one end thereof for receiving and supporting a roller therein. In addition, the peripheral surfaces of the valve lifter body may be impregnated with a solid film lubricant to reduce the friction between the valve lifter body and the valve lifter guide.

One advantage of the present invention is that the valve lifter is lightweight thus reducing the reciprocating mass and corresponding frictional forces generated by the valve spring. A further advantage of the present invention is that the reduced mass of the valve lifter permits higher engine operating speeds, and the reduced friction between the peripheral surfaces of the valve lifter and valve lifter guide results in reduced fuel consumption and oil consumption.

Other objects, features and advantages of the present invention will be readily appreciated as the same becomes better understood after reading the following description in conjunction with the accompanying drawings.

BRIEF DESCRIPTION OF THE DRAWINGS

FIG. 1 is a partial fragmentary view of a valve train according to the present invention illustrated in operational relationship to an internal combustion engine.

FIG. 2 is a front view of a valve lifter according to the present invention of the valve train of FIG. 1.

FIG. 3 is a sectional view taken along line 3—3 of FIG. 2.

FIG. 4 is an enlarged view of a portion in circle 4 of FIG. 3.

FIG. 5 is an enlarged view of a portion in circle 5 of FIG. 3.

DESCRIPTION OF THE PREFERRED EMBODIMENT(S)

Referring to the drawings and in particular to FIG. 1 thereof, a valve train 10 according to the present invention, is illustrated in operational relationship to an engine, generally indicated at 11, such as an internal combustion engine. The engine 11 includes a cylinder block 12 having at least one and preferably a plurality of hollow cylinders 14 therein. The engine 11 also includes a cylinder head 16 secured to the cylinder block 12 by suitable means such as fasteners (not shown). It should be appreciated that the cylinder head 16 includes an intake passageway and an exhaust passageway interconnecting the cylinders 14.

The valve train 10 includes at least one, preferably a plurality of cam shafts 18 for opening and closing at least one, preferably a plurality of valves 20. Each valve 20 has a head portion 22 and a stem portion 24. Each cam shaft 18 is rotatably supported within the cylinder head 16 as is known in the art and has at least one, preferably a plurality of lobes 26 which contact a valve lifter, generally indicated at 28. The valve lifter 28 is slidably disposed in a valve lifter guide 30 and acts on a push rod 32 which contacts a pivotal rocker arm 34. The rocker arm 34 engages the stem portion 24 of the valve 20 which is slidably disposed in a valve guide 36. The valve train 10 further includes a valve spring 38 disposed about the stem portion 24 of the valve 20 and has one end contacting the cylinder head 16 and the other end connected to the valve stem 24. The valve spring 38 urges the head portion 22 of the valve 20 into engagement with a valve seat 40 on the cylinder head 16 to close the passageway.

Referring now to FIGS. 2 through 5, the valve lifter 28, according to the present invention, is shown. The valve lifter 28 includes a valve lifter body 42 which slides in the valve lifter guide 30. The valve lifter body 42 is preferably manufactured from a metal material such as a die cast high strength aluminum alloy or magnesium alloy with the wear/bearing surfaces hard anodized. The anodizing process results in a coating which is submicroscopically porous for allowing a solid film lubricant 46 (FIG. 4) to be impregnated within the valve lifter body 42 prior to finish grinding. It is important that the depth of the anodized layer be adequate, approximately 30–40 microns, to support the bearing loads. Also the anodizing process should produce an anodized layer of sufficient depth and integrity that it does not crumble under fatigue loading. The solid film lubricant 46 must be impregnated to a depth of at least a few microns greater than the expected wear, e.g., if expected wear is around 30 microns then a solid film lubricant impregnation to approximately 35–40 microns is satisfactory.

The solid film lubricant 46, as used herein, is a solid lubricant that has a coefficient of friction of 0.02–0.01 at 600° F. The solid film lubricant 46 is preferably a composite, by volume of 40% graphite, 20% $MoS_2$ and the remainder a thermally stable (does not decompose up to 375° C. or 700° F.) polymer such as polyarylsufone or a high temperature epoxy such as bisphenol with appropriate curing agent. This solid film lubricant 46 has a strong affinity for conventional lubricating oils which promotes rapid formation of a stable oil film which reduces the friction between the wearing surfaces subject to high loads. The solid lubricant may also be a metal matrix composite having about 40% graphite and the remainder aluminum or cast iron. Such metal matrix composite may be formed by powder metallurgy or other suitable means to provide a porus material that can expose graphite for intermittent or supplementary lubrication purposes. Up to 13% of the graphite may be substituted with boron nitride. The solid lubricant may also include up to 10% copper and one of several of LiF, NaF and CaF, as substitute for the $MoS_2$.

As illustrated in FIG. 2, the wear surfaces of the valve lifter body 42, i.e. the peripheral surfaces of the valve lifer body 42 which contact the valve lifter guide 30, are formed by raised annular portions 44 on the valve lifter body 42. It should be appreciated that the width of the raised annular portions 44 is minimized to reduce the surface area of the valve lifter body 42 that contacts the valve lifter guide 30, thereby reducing the friction between the valve lifter 42 and the lifter guide 30. To further reduce the friction between the valve lifter body 42 and the corresponding valve lifter guide 30, the raised annular portions 44 are impregnated with the solid film lubricant 46 set forth above to further reduce the sliding or wear surface friction.

Referring to FIGS. 2 and 3, the valve lifter 28 also includes a roller cam follower, generally indicated at 47, connected to the valve lifter body 42 at one end thereof. The roller cam follower 47 includes a ceramic roller 48 made of silicon nitride or toughened alumina, which reduces roller weight by as much as 65% over a conventional metallic roller. The ceramic roller 48 is rotatably mounted in a U-shape cradle 50 formed on one end of the valve lifter body 42. The ceramic roller 48 includes a follower portion 52 which engages and follows the cam lobe 26 and a shaft portion 54 which is seated in the cradle 50 of the valve lifter body 42. The shaft portion 54 includes a bore 55 extending therethrough to further reduce the weight of the ceramic roller 48. It should be appreciated that while the roller 48 shown herein is of one piece, integral construction. It should also be appreciated that the roller 48 may also be fabricated in two or more components manufactured from different materials, i.e. the follower portion 48 and shaft portion 54 may be made separate and from different ceramic materials, metallic materials, or a combination thereof. It should further be appreciated that, depending upon the strength and weight of the material, a solid shaft may be used.

Additionally, the ceramic roller 48 is secured to the valve lifter body 42 by generally U-shaped clips 56 having detent projections 58 which engage recesses 60 located on the valve lifter body 42. The bearing surface of the cradle 50 is hard anodized and impregnated with the solid film lubricant 46 set forth above to further reduce the frictional forces acting against rotation of the shaft 54. It should be appreciated that the use of a one piece ceramic roller cam follower 48 rotatably secured in a cradle 50 on the valve lifter body 42 impregnated with a solid film lubricant 46 substantially reduces the overall weight of the valve lifter 28 and reduces the amount of lubrication required in the area between the shaft portion 54 and the cradle 50.

Accordingly, the valve train 10 uses a lightweight valve lifter 28, utilizing a solid film lubricant 46 impregnated on bearing surfaces 44 and a lightweight low friction roller 48 as set forth above. The valve lifter 28 reduces the contact friction and the reciprocating mass of valve train 10 which permits higher engine operating speeds, and improvement in power output rating, and a reduction in fuel consumption.

The present invention has been described in a illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A valve lifter comprising:

a light weight valve lifter body including a cradle, wherein said valve lifter body is manufactured from at least one material selected from a group consisting of magnesium and aluminum;

a roller having a follower portion and a shaft portion, said shaft portion being rotatably disposed on a surface in said cradle, wherein said roller is manufactured from a ceramic material or a lightweight metal ceramic composite; and peripheral surfaces of said valve lifter body and said surface of said cradle being impregnated with a solid film lubricant that has an affinity for oil and promotes rapid formation of a stable oil film.

2. A valve lifter as set forth in claim 1 wherein said roller is comprised of silicon nitride.

3. A valve lifter as set forth in claim 1 wherein said roller is comprised of a toughened alumina.

4. A valve lifter as set forth in claim 1 wherein a portion of said peripheral surfaces of said valve lifter body is treated such that the treated portion has an open porosity.

5. A valve lifter as set forth in claim 4 wherein said solid film lubricant is impregnated on said treated portion.

6. A valve lifter as set forth in claim 5 wherein said solid film lubricant is comprised of a polymer based molybdenum disulfide and graphite mixture.

7. A valve lifter as set forth in claim 1 wherein said shaft portion comprises a cylinder.

8. A valve lifter as set forth in claim 1 wherein said follower portion is formed of a first material and said shaft portion is formed of a second material.

9. A valve lifter as set forth in claim 1 including a spring clip securing said roller to said valve lifter body and having inwardly projecting detent members engaging a pair of recesses located on said valve lifter body.

10. A valve lifter as set forth in claim 9 wherein said spring clip engages said shaft of said roller to secure said roller to said valve lifter body.

11. A valve lifter, comprising:

a valve lifter body having anodized, solid film lubricant impregnated side wearing surfaces;

a U-shaped cradle on one end of said valve lifter body;

a ceramic roller rotatably mounted in said U-shaped cradle; and a clip having detent projections extending inwardly and engaging recesses on said valve lifter body to secure said roller on said valve lifter body.

12. A valve lifter as set forth in claim 11 wherein said ceramic roller is made from at least one material selected from a group consisting of silicon nitride and aluminum.

13. A valve lifter as set forth in claim 11 wherein said valve lifter body comprises at least one element selected from a group consisting of magnesium or aluminum.

14. A valve lifter as set forth in claim 11 wherein said solid film lubricant is comprised of a polymer based molybdenum disulfide and graphite mixture.

15. A valve lifter as set forth in claim 11 wherein said U-shaped cradle includes an anodized, solid film lubricant impregnated bearing surface.

16. A valve lifter, comprising:

a valve lifter body having an anodized, solid film lubricant impregnated side wear surface;

a U-shaped cradle formed on one end of said valve lifter body having a bearing surface, said bearing surface impregnated with a solid film lubricant;

a roller having outwardly projecting shaft portions rotatably mounted on the bearing surface; and a clip having inwardly projecting detent projections which coact with recesses located on said valve lifter body to secure said roller to said valve lifter body.

17. A valve lifter as set forth in claim 16 wherein said valve lifter body is made from at least one material selected from a group consisting of magnesium and aluminum.

18. A valve lifter as set forth in claim 16 wherein said roller is formed of a ceramic material.

* * * * *